United States Patent [19]

Mamo

[11] Patent Number: 4,485,742

[45] Date of Patent: Dec. 4, 1984

[54] FIREARM BULLET

[76] Inventor: Anthony C. Mamo, 1515 E. Central Ave., Apt. 264B, Arlington Heights, Ill. 60004

[21] Appl. No.: 271,083

[22] Filed: Jun. 5, 1981

[51] Int. Cl.[3] ..... F42B 5/02; F42B 11/00

[52] U.S. Cl. ..... 102/430; 102/503

[58] Field of Search ..... 102/503, 511, 514–516, 102/529, 435, 442, 430, 439; 244/3.23

[56] References Cited

U.S. PATENT DOCUMENTS

| | | | |
|---|---|---|---|
| 53,582 | 4/1866 | DeCousy | 102/503 |
| 442,476 | 12/1890 | Bowman | 244/3.23 |
| 590,428 | 9/1897 | Bennett | 102/503 |
| 627,929 | 6/1899 | Andrews | 102/511 |
| 1,023,469 | 4/1916 | Haslett . | |
| 1,189,011 | 6/1916 | Smith | 102/511 |
| 1,292,388 | 1/1919 | Bowers . | |
| 2,352,260 | 6/1944 | Herman . | |
| 2,433,334 | 12/1947 | Birkeland . | |
| 3,282,214 | 11/1966 | Brescoe | 102/517 |
| 3,349,711 | 10/1967 | Darigo et al. | 102/514 |
| 3,398,682 | 8/1968 | Abela | 244/3.23 |
| 3,528,373 | 9/1970 | Jean . | |
| 3,938,440 | 2/1976 | Dooley et al. | 102/430 |
| 4,175,492 | 11/1979 | Knappworst et al. | 102/503 |
| 4,204,474 | 5/1980 | Mizille . | |
| 4,296,893 | 10/1981 | Ballmann | 244/3.23 |

FOREIGN PATENT DOCUMENTS

| | | | |
|---|---|---|---|
| 308434 | 2/1920 | Fed. Rep. of Germany | 102/503 |
| 1003155 | 4/1902 | France | 102/435 |
| 27973 | 1/1910 | Sweden | 102/511 |
| 1971 | of 1867 | United Kingdom | 102/430 |
| 19912 | of 1893 | United Kingdom | 102/503 |

*Primary Examiner*—Harold J. Tudor

*Attorney, Agent, or Firm*—Balogh, Osann, Kramer, Dvorak, Genova & Traub

[57] ABSTRACT

Ammunition having increased projectile velocity and energy without increasing the chamber pressure within a firearm such as a handgun, rifle, anti-aircraft gun, canon, etc. This is accomplished by simultaneously incorporating at least two of three interdependent modifications. The concept consists of using a specific gunpowder pseudo overcharge by adding more and/or faster burning explosive, in conjunction with a projectile having an internally jacketed axial bore. The jacketed bore must possess sufficient area to prevent the pseudo overcharge pressure from exceeding the predetermined pressure specification. The net result is a pressure and confident modification of the gunpowder burning parameters which produce much higher average propulsion pressure for any given peak pressure.

12 Claims, 5 Drawing Figures

FIG. 1
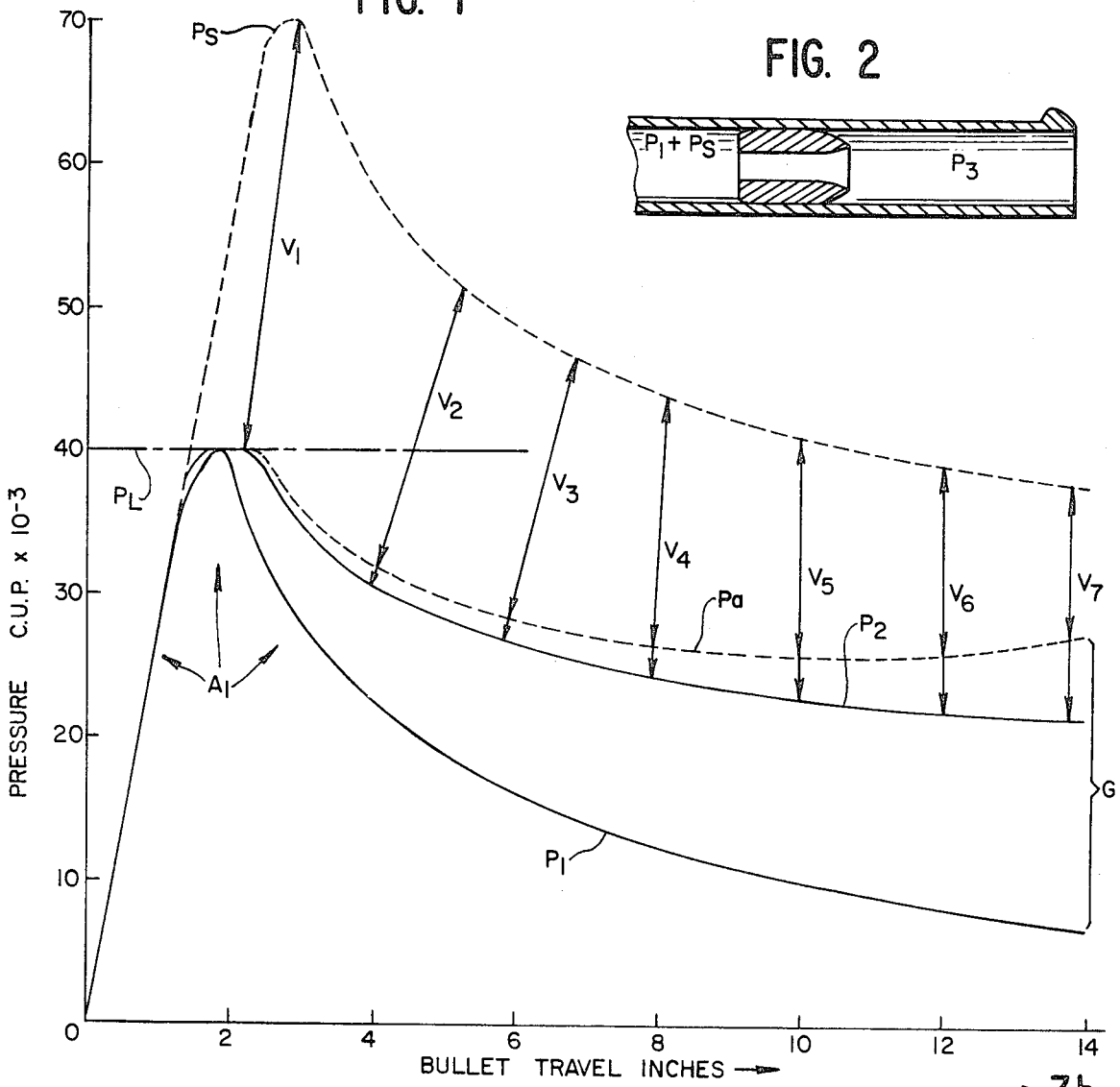
FIG. 2
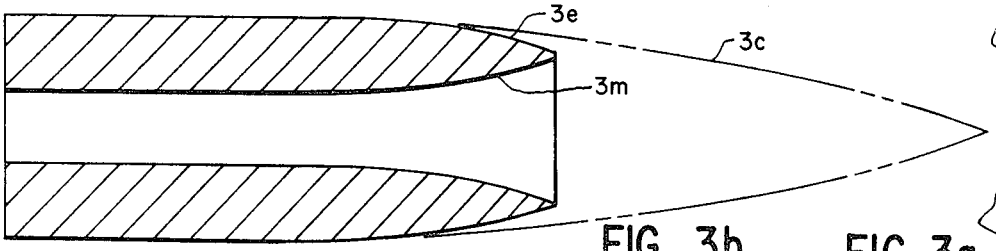
FIG. 3b
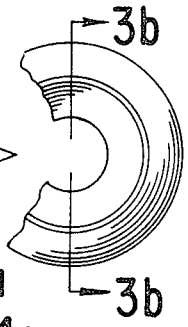
FIG. 3a
FIG. 4a
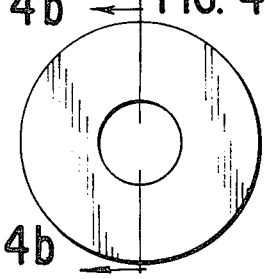
FIG. 4b
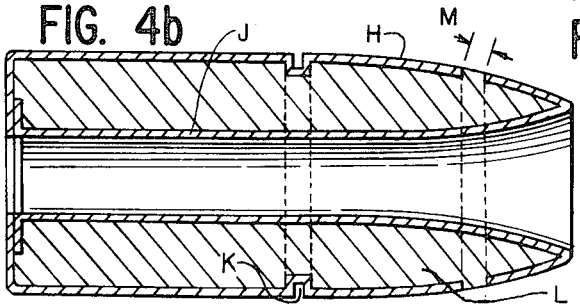
FIG. 4c
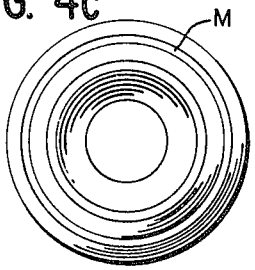

FIREARM BULLET

SUMMARY OF THE INVENTION

Although expired and current prior art disclose bullets with central bores, the objectives sought and the results were unlike those of the present invention. Prior art structures did not disclose a functional and structural interdependency of the mated simultaneous modifications which about double the bullet propulsion energy without increasing the peak pressure of the gun or firearm. Also, no prior art has specified the use or need of both internal and external jacketed liners with mated ogives. And none have disclosed the placement of a lubricant within the internal jacketed bore.

It is common knowledge among those skilled in ballistics that improvements in any of the following properties is highly desirable to gun enthusiasts of all kinds and to the military in particular. The embodiments of this invention will significantly improve performance of the following areas:

1. Much higher projectile velocity and energy for any given chamber pressure;
2. Much higher ballistic coefficient for a given ogive caliber;
3. Reduce projectile overhang 75% for a given ogive caliber;
4. Much flatter projectile trajectory;
5. Shorter barrel and lighter weight gun for a given bullet energy;
6. Extended barrel life for a given bullet velocity and energy;
7. Effective true recoil control;
8. Provide for the effective safe use of high caliber ogives in revolvers, automatic and rapid fire weapons;
9. A 45% reduction of bullet lengths for high ogival calibers;
10. Provide for the safe use of high caliber ogives in all tubular feed weapons;
11. Provide for the normally incompatible use of heavy bullets and fast burning powders; and
12. Require less twist for equal stability.

To such ends, the following pages are directed.

A primary objective of this invention is to obtain much greater bullet velocity and energy for any given design limitation of gun chamber pressure, caliber and projectile weight. This is accomplished without chemical modification of the explosive.

BRIEF DESCRIPTION OF THE DRAWINGS

Referring to the accompanying drawings which are for illustrative purposes only:

FIG. 1 is a curve showing the relationship between firearm chamber pressure and bullet travel.

FIG. 2 shows a cross-section of part of a gun barrel and bullet to designate pressure areas.

FIG. 3*a* shows a bullet of the present invention, partial front view.

FIG. 3*b* shows a cross-section side view of a bullet of the present invention taken on lines 3*b*—3*b* of FIG. 3*a*.

FIG. 4*a* is a rear end view of a bullet of the present invention.

FIG. 4*b* is a cross-section of the jackets of a bullet of the present invention.

FIG. 4*c* is a front end view of the bullet jackets of FIG. 4*b*.

Figure 5:
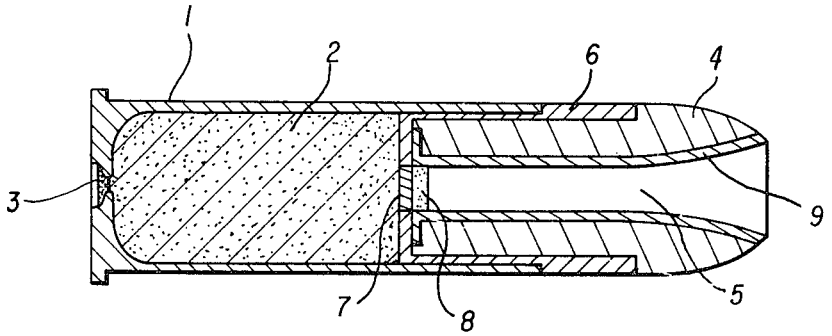
FIG. 5 is a cross-section of the combination of the assembly of a pre-fired ammunition which forms the present invention.

The curve of FIG. 1 shows pressure on the vertical column and projectile travel in inches on the horizontal base. $P_L$ shows the upper limit of safe chamber pressure for a particular gun, in the case illustrated, a 0.357 Magnum with a limiting pressure of 40,000 c.u.p. C.u.p. refers to copper units of pressure, which is an industry standard of measuring pressure. The area under the pressure curve is always proportional to the energy available for bullet propulsion (in this case area $A_1$). In this teaching, we use an excess; and/or a faster burning powder to produce ($P_s$) which represents a pseudo overpressure, that in this case would have reached a peak pressure of 70,000 c.u.p. if not used with a mated second simultaneous modificaion, which provides for venting through the jacketed bore of the bullet a predetermined part ($V_1$–$V_7$) of the excess pseudo overpressure (in this case, 0.57% of the instantaneous pressure) to very advantageously modify the potential overpressure ($P_s$) to that shown by ($P_a$=actual pressure), for an overall gain in bullet propulsion energy represented by area (G), in this case, a gain of 80%. The ($P_s$) pressure would have dropped to that shown by ($P_2$) if the bullet was stationary, however, as the bullet acclerates, venting (see FIG. 2) of higher pressure to lower pressure ($P_1+P_s \rightarrow P_3$) becomes progressively less by the square of the instantaneous bullet velocity times a factor (M) representing the effects of barrel length, barrel volume and the stagnation pressure at the nose of the bullet orifice ($P_3$) caused by the total mass density effect of moving the confined gas in and near the barrel at supersonic velocities. Thus, as the bullet accelerates, ($P_3$) becomes greater, which in turn increases the resistance to the escaping gas from the high pressure side of the orifice, ($P_1+P_s$) thus providing an effective means of selective venting and much higher average propulsion pressure. This is accurately represented by the relative areas under the normal curve ($A_1$) and the area under the curve ($P_a$) showing the combined effects of such mated modifications. The upward slope of ($P_a$) at the higher projectile velocities and starting at 10 inches of travel, indicates that the gains will be much greater with longer barrels and/or faster projectile velocities; (a cottom wad or other thin partition is placed between the powder charge and the bullet bore to prevent spillage of powder).

(Flatter Trajectory and Higher Ballistic Coefficient (B.C.)

As is well known, the flatest trajectory is produced by the highest B.C. for any given initial velocity and bullet weight. It is also known that for any given shape, the air resistance of projectiles varies as the square of the frontal area, with all other variables being equal. Therefore, according to the proposed bullet geometry, the frontal area can be effectively reduced by providing the longitudinal concentric jacketed bore or orifice on the central axis of said bullet. As an example, if we provide a 0.140 inch diameter orifice in a 0.357 caliber bullet, the frontal area would only be .0847 $IN^2$ instead of the normal .1001 $IN^2$. Therefore, even at the same outside diameter and external nose shape, the all important B.C. would be improved by $(.0847/.1001)^2=1.397$, for a 140% gain due to area reductions alone. However, in addition, this jacketed bore design allows the use of an (8), (9) or (10) caliber ogive in essentially the same length as is usually required for a (1) or (2) caliber ogive. This alone would also improve the B.C. an additional 31.8% for a total improvement of 1.318+1.397=172% thereby providing a significant improvement in both trajectory and downrange energy.

A hard, temperature resistance liner or jacket is perferable in the bullet bore (particularly for hot loads) to maintain accuracy. Without such liner or jacket, the high velocity, hot escaping overpressure gases would tear out and melt part of the soft bullet bore and thereby unbalance the spin axis which in turn would reduce both accuracy and B.C. Bore jackets or liners of brass, steel, copper, zinc and certain plastics are satisfactory, as are unjacketed hollow bullets of these same temperature and pressure resisting materials.

Another object of the invention is to overcome a long-standing ballistic parameter of limitation which dictates that large heavier bullets must use the slower burning powders to avoid erratic pressures and inconsistent performance. This in turn also requires a heavier and longer barrel to provide an effective energy transfer to the bullet. It is also well known that erratic and dangerous pressure buildup will occur when fast or moderately fast burning-rate powders are used with heavy bullets. This is due to the extended confinement period of the gases, caused by the high inertia and higher static friction of the larger and heavier bullets. Also, although well over a hundred gunpowders exist, only a few are satisfactory for each specific weight of bullet, length of barrel and diameter of bore. Furthermore, high energy, fast burning powders are inclined to deform both the base and nose of the unprotected lead bullet due to the high acceleration impact. All of the above limitations are expanded or entirely eliminated by the simultaneous use of a specific powder overcharge (through more powder and/or faster burning powder) in combination with a bullet with a jacketed orifice of matched specific area.

The orifice cushions and reduces the high acceleration impact of fast burning powders to reduce or eliminate bullet deformation, and the orifice eliminates the extended gas confinement caused by the greater inertia and static friction of the heavy bullets. Therefore, for a given bullet caliber weight and energy combination, this teaching optionally provides for a shorter and lighter barrel as well as the use of much faster burning powders even with very heavy bullets. Thus, any powder type can now be effective over a wide range of projectile variables, and it is also now possible to effectively use a very broad variety of propellants for any given bullet parameter.

Extended Barrel Life and Lubrication

It is well know in the art that bullets of high muzzle velocity or high down range energy or high accuracy are increasingly often partially or fully jacketed. Military bullets are also usually of this type and increasing numbers of sporting bullet types are becoming jacketed each year. Although jacketed projectiles have several advantages, they have little or no provision for lubrication and therefore produce rapid barrel deterioration. This is particularly true for high velocity and/or rapid fire conditions. According to the present teaching, a partition containing a small amount of lubricant could be encapsulated between the bullet and the powder; or the lubricant could be confined in the jacketed bore of the bullet of the proposed design. The impact energy of the escaping pseudo overpressure would supersonically pulverize the lubricant and provide an effective fresh mist-type lubrication within the entire barrel, just ahead of the bullet and just as the bullet starts to move.

Other researchers have measured the normal energy loss due to barrel friction to be about 9.5%. Crude unoptimized early tests suggest barrel friction of such internally vented jacketed bullets is reduced 35% to 80% by the aforementioned mist lubrication means. Since barrel life is primarily a function of pressure shock cycles, thermal shock cycles and friction shock, it would be reasonable to conclude that significant reductions of the shock factors, coupled to the above reductions in friction, should significantly extend barrel life. Reference to FIG. 1 and comparison of the slope of $P_1$ to the slope of $P_a$ shows an approximate 3.6 to 1 reduction of pressure shock (change in pressure per unit of time). Thermal shock slope (change in temperature per unit of time) is even more significantly improved, and the barrel is also more gradually heated by the lower temperature vented gas/oil mist ahead of the bullet and the resulting Joule Thomson effect (extensive cooling by high pressure venting through an orifice). In combination, the three shock reductions could provide barrel life improvements in the range of 5:1 for any given bullet velocity, weight, caliber and composition. Since engineering treatment of such shock effects on the fatigue life of metals indicate that life varies as the square and sometimes the cube of the combined shock cycles, a five-to-one gain in barrel life appears conservative.

Recoil

As is well known, recoil reduces accuracy in two primary ways: One, it causes bullet deviation from the target aim point because the gun is in the process of moving while the bullet is traveling along the barrel to establish its own trajectory. During bullet propulsion, every variable of the shooter and gun will have an effect on the quality and magnitude of the recoil and subsequently the flight path of the bullet. Porting, or recoil vents are often laced at the end of the barrel to reduce the recoil. Unfortunately, recoil reduction happens essentially after the bullet has left the barrel. All hand-held, anti-recoil devices and vents are activated by back pressure and back pressure does not reach the activating ports until the bullet is nearly out of the gun and the back-pressure is least. Therefore, the bullet travel is subjected to 94% of the full recoil deviation whether the gun is ported or not. According to this invention, the jacketed orifice in the bullet bore would allow very substantial pressure to reach the anti-recoil vents just as the bullet starts to move. In this case, all reductions of recoil are literally 100% effective in reducing deviations from the aim point. With this concept, it is theoretically possible to eliminate nearly all of the vertical and horizontal components of the recoil motion while the bullet is accelerating. This provides superior accuracy, especially in rapid fire conditions such as for military and police interests. For all but the trained expert, high recoil amplifies flinching and the flinching movement adds to the recoil deviations for poorer inconsistant scores.

Therefore, the aforementioned highly effective recoil reduction technique should also reduce flinching which in combination can be expected to significantly improve accuracy.

In summary, it has been shown that when a predetermined pseudo overpressure powder charge is used in conjunction with a bullet providing mist lubrication and having a concentric jacketed orifice of a specific over-pressure related area, the limitations of 1 through 13 are exceeded or entirely eliminated as follows:

Muzzle energy can be about doubled without exceeding pressure specifications and down range energy would be tripled at some practical downrange distance.

Diameter-for-diameter and weight-for-weight, the B.C. of the very best of prior art bullets can be improved from 40% to 60% depending on the specific caliber, while the B.C. of bullets with a 1 or 2 caliber ogive can be improved from 75% to as much as 95%. Both are accomplished without the usual overhang extension requirements. This greatly reduces the unsupported weight of high B.C. bullets and this in turn adds to bullet stability and accuracy (see FIG. 3*b* for comparison), 3*c* being a conventional 10-caliber length and overhang 3*e* being the external, and 3*m* being the internal 10-caliber ogive of the new design, having a 40% greater B.C. and much less length and overhang.

Another fringe benefit of this invention is the fact that weight-for-weight and caliber-for-caliber, the vented bullet will have its average mass further from the spin axis, therefore, such a bullet will require less twist for a given stability, and less twist means more energy available for propulsion.

It is also known in the art that bullets with very high B.C. are seldom if ever used in rapid fire instruments. This is so because such bullets have long sharp noses and long unsupported weights, as would be true for projectiles with 8, 9 or 10 caliber ogives. It is another object of this ivention to (in effect) provide such caliber ogives with a 3:1 reduction in unsupported overhang and to (in effect) eliminate the length and sharp nose effect so detrimental to use in automatics, revolvers and rapid fire weapons.

In spite of the many advantages of high caliber ogival (8, 9 and 10) shapes, they are too long to fit revolvers and they cannot be safely fired from automatic weapons and therefore are almost exclusively used by single shot firarms. Also, they are almost never used in tubular feed guns as the sharp nose of one bullet can activate the primer of the bullet ahead to it. FIG. 3*b* compares a conventional ten caliber (broken lines) ogive to the shortened ten caliber nose shape of the new design. The flared-out hollow nose may now be larger than the primer diameter ahead of it but it still exhibits a true ten caliber ogive with equal land contact area and reduced twist requirement due to the greater radius of gyration of the new design. Also, the frontal nose area of the new design is several magnitudes greater for any caliber ogive. This provides much lower unit nose pressure during automatic and rapid fire conditions.

A preferred embodiment of the bullet is shown in cross-section at FIG. 4*b*. The internal jacket (J) may be flared at both ends to prevent separation and resist bore melt of the bullet; the external jacket (H) may be indented or knurled at (K) and may be crimped or folded inwardly at both ends to prevent separation or fouling of the barrel; the internal and external jackets (J) and (H) are in gap proximity (M) in at least one end to allow excess lead (L) to exude during forming.

FIG. 5 of the drawings illustrates the assembled combination of a conventional cartridge casing 1 for containing in place the explosive powder 2. A primer 3, on being impacted by a firing pin of a firearm, ignites to cause explosion of the powder 2. The vented projectile 4 is conventionally secured to the open end of the casing 1. 4 is illustrated with axial vent 5 and an outer jacket 6 and an inner jacket 9. The rer opening of vent 5 is blocked by a rupturable partition 7. FIG. 5 also shows the positioning of a lubricant charge 8 disposed adjacent the rupturable partition 7.

For short range target shooting, the powder charge may be omitted and a lightweight projectile with a small area vent may be used. The small area vent permits the use of inexpensive plastic projectiles that would otherwise be disintegrated or nose perforated by the shock impact of primers. The same damage would occur if black powder was used with a lightweight, low-cost plastic projectile such as polyethelene or the like.

Black powder is a class II explosive and the burn rate is so fast that a heavier, stronger and more expensive plastic would be required without the projectile vent.

Adding the above weight reduces range and velocity and adding cost defeats the objective of low cost plinking, and both must be added if the bullet is not vented and used with primers or black powder.

While I have shown and describe several embodiments of the present invention, it is to be understood that such specific reference having to do with materials, velocities, sizes, percent of improvement, coefficients. etc., are by way of explanation of the new concept. And such references are susceptible to numerous modifications without deviating from the scope of the teachings and, therefore, I do not wish to be limited to the details used for explanation but rather intend all such modifications and optimizations as are encompassed by the scope of the disclosure and the appended claims.

I claim:

1. In firearm ammunition, the combination of:

a powder charge;

a cartridge case means for holding said powder charge;

a primer for igniting said powder charge;

a projectile disposed in one end of said cartridge case means and having axial vent means; and partition means disposed to block said axial vent means and being rupturable upon ignition of said powder charge;

the amount of said powder charge being of such predetermined value as would produce a destructive chamber over-pressure for a particular firearm; and the area of said vent means being of such predetermined size as to permit escape of a portion of the combustion pressure through said vent means and ahead of the projectile while it is still in the barrel of the particular firearm, to prevent an over-charge explosion force from reaching a value that would normally be destructive if used with an unvented projectile in the particular firearm.

2. The invention of claim 1 wherein said partition means carries a lubrication media.

3. The combination of claim 1, wherein said projectile has a core of soft metal, said core having an external jacket, and an internal jacket forming said axial vent means.

4. The combination of claim 3, wherein the edge of the external jacket and the edge of the internal jacket are separated by a gap.

5. The combination of claim 3 wherein said axial vent means comprises a single longitudinal bore which is outwardly flared in at least one end.

6. The combination of claim 3, wherein said projectile is characterized by an external ogival contour, and said axial vent means comprises an axial bore having at least one end flared outwardly to provide an internal ogival contour of similar caliber to said external ogival contour.

7. The combination of claim 3 characterized by at least one 10-caliber ogival contour having an overall projectile length of less than 4-caliber.

8. The combination of claim 6 comprising an overall projectile length less than 3% of the ogival caliber.

9. The combination of claim 3 wherein said external jacket is open at both ends.

10. The combination of claim 3 comprising bleed holes in the cylindrical surface of at least one of said jackets.

11. The combination of claim 1 characterized in that said projectile has a predetermined frontal area and the smallest area of said axial vent means being less than said frontal area of the projectile.

12. The combination of claim 1, characterized in that said axial vent means of said projectile is circular and concentric with the spin axis of the projectile.

* * * * *